US010480302B2

(12) United States Patent
Irani et al.

(10) Patent No.: US 10,480,302 B2
(45) Date of Patent: Nov. 19, 2019

(54) FRACTURING AND IN-SITU PROPPANT INJECTION USING A FORMATION TESTING TOOL

(71) Applicant: Halliburton Energy Services, Inc., Houston, TX (US)

(72) Inventors: Cyrus Irani, Houston, TX (US); Charles Seckar, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 83 days.

(21) Appl. No.: 15/513,093

(22) PCT Filed: Nov. 24, 2014

(86) PCT No.: PCT/US2014/067138
§ 371 (c)(1),
(2) Date: Mar. 21, 2017

(87) PCT Pub. No.: WO2016/085451
PCT Pub. Date: Jun. 2, 2016

(65) Prior Publication Data

US 2017/0292359 A1 Oct. 12, 2017

(51) Int. Cl.

| | |
|---|---|
| ***E21B 43/26*** | (2006.01) |
| ***E21B 49/10*** | (2006.01) |
| ***E21B 43/267*** | (2006.01) |
| ***E21B 7/00*** | (2006.01) |
| ***E21B 49/08*** | (2006.01) |

(52) U.S. Cl.
CPC ..... *E21B 43/267* (2013.01); *E21B 7/007* (2013.01); *E21B 49/082* (2013.01); *E21B 49/10* (2013.01)

(58) Field of Classification Search
CPC ..... E21B 49/10; E21B 49/008; E21B 43/26; E21B 49/08; E21B 2049/085; E21B 49/00; E21B 49/06; E21B 49/081
See application file for complete search history.

(56) References Cited

U.S. PATENT DOCUMENTS

| | | | | |
|---|---|---|---|---|
| 5,417,284 | A | 5/1995 | Jones | |
| 8,146,416 | B2 * | 4/2012 | Pisio | E21B 43/26 73/152.51 |
| 2007/0261852 | A1 | 11/2007 | Surjaatmadja et al. | |
| 2008/0066537 | A1 * | 3/2008 | Hegeman | E21B 43/25 73/152.28 |
| 2008/0078548 | A1 | 4/2008 | Pauls et al. | |

(Continued)

OTHER PUBLICATIONS

International Search Report and the Written Opinion of the International Search Authority, or the Declaration, dated Jul. 24, 2015, PCT/US2014/0671384, 16 pages, ISA/KR.

*Primary Examiner* — Kipp C Wallace
(74) *Attorney, Agent, or Firm* — Haynes and Boone, LLP

(57) ABSTRACT

A formation testing tool which performs the dual function of fracturing and in-situ proppant placement. The testing tool houses proppant slurry having proppant and fracture fluid therein, and a probe which seals against the wellbore wall. During operation, the probe seals against the wellbore wall whereby fluid communication may take place. Using a pump aboard the testing tool, the fracture fluid is forced through the probe and into the formation to produce the fractures. The testing tool, which has a pressurized compartment, then injects the proppant into the fractures.

14 Claims, 4 Drawing Sheets

(56) References Cited

U.S. PATENT DOCUMENTS

| | | | | |
|---|---|---|---|---|
| 2008/0115575 | A1* | 5/2008 | Meek | E21B 17/10 73/152.24 |
| 2008/0271894 | A1 | 11/2008 | Hill et al. | |
| 2009/0250207 | A1* | 10/2009 | May | E21B 49/008 166/250.1 |
| 2011/0284227 | A1* | 11/2011 | Ayan | E21B 43/16 166/307 |
| 2011/0303409 | A1* | 12/2011 | Harrigan | E21B 49/008 166/264 |
| 2014/0158345 | A1* | 6/2014 | Jang | E21B 43/00 166/250.1 |
| 2014/0182844 | A1 | 7/2014 | Wutherich et al. | |
| 2014/0196532 | A1* | 7/2014 | Bullock | E21B 49/10 73/152.24 |

* cited by examiner

FRACTURING AND IN-SITU PROPPANT INJECTION USING A FORMATION TESTING TOOL

PRIORITY

The present application is a U.S. National Stage patent application of International Patent Application No. PCT/US2014/0671384, filed on Nov. 24, 2014, the benefit of which is claimed and the disclosure of which is incorporated herein by reference in its entirety.

FIELD OF THE DISCLOSURE

The present disclosure relates generally to formation fluid testing and, more specifically, to formation testing tools capable of fracturing the formation and injecting proppant into the factures.

BACKGROUND

Methods for well testing during wireline operations early in the exploratory life of a hydrocarbon bearing field are well established. Often the formation testing operation will identify formations of interest that deserve additional attention, but are too tight to deliver useful information in the limited amount of time available for a wireline operation. Usually these tight formations have permeabilities of 1 md or much less. Thus, a fracturing operation is required to create additional permeability in the formation so that a sufficient amount of reservoir fluid adequate for analysis is made available during the limited amount of time available for wireline operations.

A conventional fracturing operation is undertaken from the surface, and has two phases. In the first phase, a fracture is created by the expediency of exerting pressure that is greater than the existing formation/hydrostatic pressure against the face of the formation. This pressure is generated from pumps on the surface which force the fluid/slurry downhole to create the fractures. This additional pressure will cause the fracture to form, but the fracture will spontaneously close when the additional exerted pressure is removed.

To prevent fracture closure and the accompanying loss of fracture-induced improved permeability, it is standard practice to fill the fracture with proppant (i.e., the second phase of conventional fracturing operations). However, the proppant is supplied at the surface by mixing it into the fluid slurry being pumped downhole. Therefore, the overall process is inefficient and time-consuming.

DESCRIPTION OF ILLUSTRATIVE EMBODIMENTS

Illustrative embodiments and related methodologies of the present disclosure are described below as they might be employed in a downhole formation testing tool which also performs fracturing and proppant placement. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, illustrative embodiments and methods of the present disclosure provide a downhole formation testing tool which performs the dual function of fracturing and proppant placement. In a generalized embodiment, the downhole tool includes a compartment containing a proppant slurry having proppant and fracture fluid, and a probe which seals against the wellbore wall using a packet/pad to hold the differential. During operation, the downhole tool is deployed (via wireline or along a drill string, for example) and positioned along a formation of interest. The probe then seals against the wellbore wall via the packer/pad whereby fluid communication may take place. Using a pump aboard the downhole tool, the fracture fluid is forced through the probe and into the formation to produce the fractures. The compartment, which is pressurized, then injects the proppant into the fractures. In an alternate embodiment, the pump is used to recharge the pressurized compartment after an initial fracturing process. In yet another embodiment, the pump is used to induce the fracture and inject the proppant. Accordingly, a more efficient, reliable and simpler formation testing operation in low permeability zones is provided.

Figure 1:
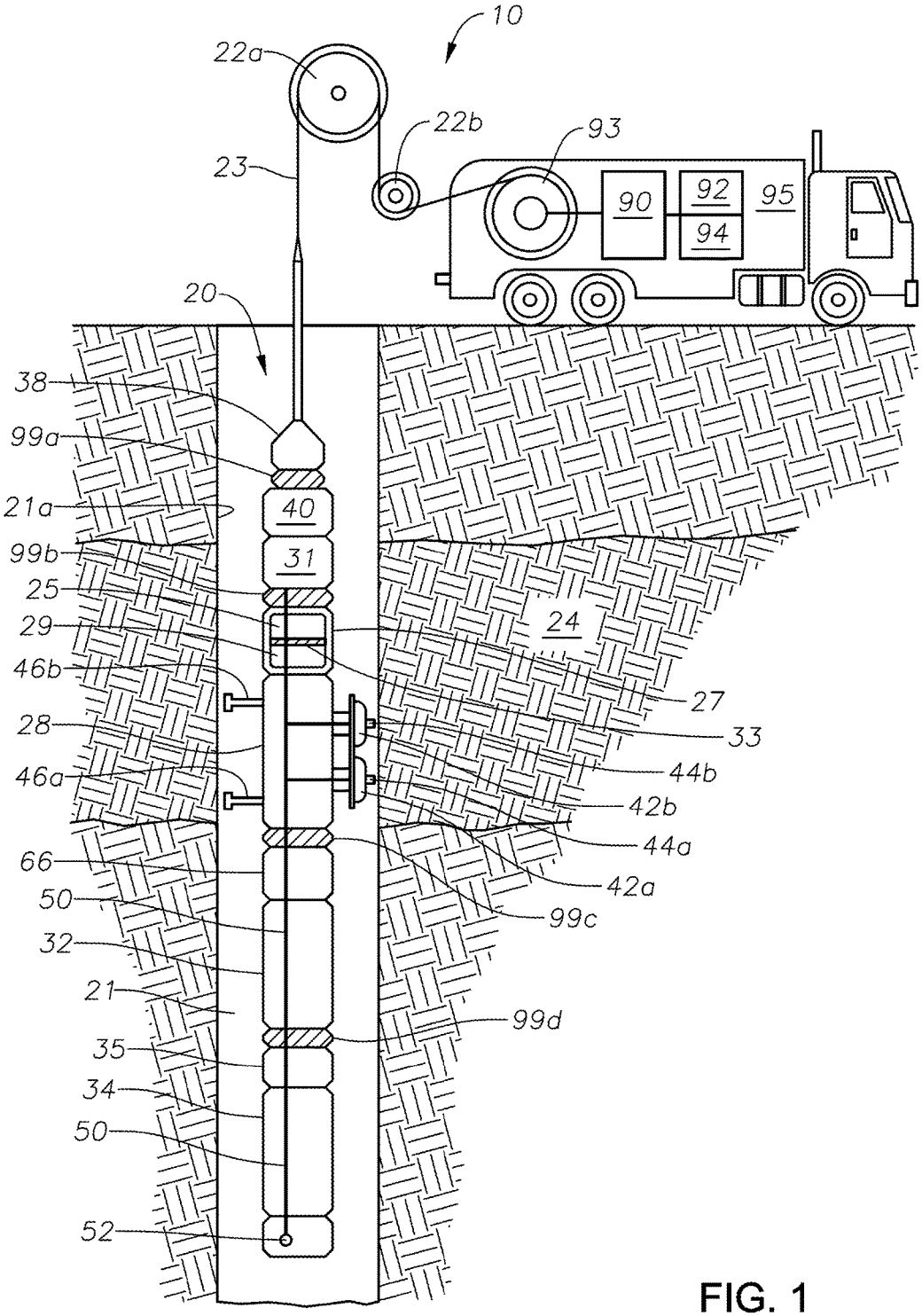
FIG. 1 illustrates a formation testing system according to certain illustrative embodiments of the present disclosure.

FIG. 1 shows a formation testing system 10, according to certain illustrative embodiments of the present disclosure. Formation testing system 10 includes a downhole formation testing tool 20 conveyed in a wellbore 21 by a wireline 23 for testing and retrieving formation fluids from a desired selected formation 24 within the wellbore 21, according to the normal operation of the formation testing system 10. In addition to fluid testing, formation testing tool 20 also conducts fracturing of formation 24 and injects proppant into those induced fractures. Formation testing tool 20 contains a number of serially coupled modules, each module designed to perform a particular function. The type of modules and their order is changeable based on the design needs. In the illustrative embodiment of FIG. 1, formation testing tool 20 includes a sequential arrangement of a fluid pumping section ("FPS") module 40, a fluid testing module 31, compartment 27 containing a pressurized tank 25 and proppant slurry housing 29, packer/probe module 28 having an electro-hydraulic system (not shown), pressure gauge 66, a fluid testing module 32, FPS module 35, and a sample collection module 34, which is comprised of any number of sample chambers (not shown). Tool 20 also contains a control section 38 that contains downhole electronic circuitry for controlling the various modules of tool 20, as well as handling two-way telemetry for control communications from master control unit 90.

In addition, tool 20 can have incorporated into its modular design any number of packer elements, four shown and designated as 99*a, b, c, d*. These packer elements are cylindrically shaped and designed so that when activated either by the injection of hydraulic fluid or by some mechanical means, they will expand in the radial direction and serve to make a hydraulic seal between the tool 20 and the formation. In practice, they can be deployed individually, or in pairs, or all simultaneously and serve to isolate parts of tool 20 from the adjoining wellbore in order to perform some specific well test operation.

Tool 20 is conveyed in wellbore 21 by the wireline 23 which contains conductors for carrying power to the various components of tool 20 and conductors or cables (coaxial or fiber optic cables) for providing two-way data communication between tool 20 and master control unit 90, which is placed uphole (on the surface) in a suitable truck 95 for land operations and in a cabin (not shown) for offshore operations, for example. Wireline 23 is conveyed by a drawworks 93 via a system of pulleys 22*a* and 22*b*.

Control unit 90 contains a computer and associated memory for storing therein desired programs and models. Control system 90 controls the operation of tool 20 and processes data received from tool 20 during operations. Control unit 90 has a variety of associated peripherals, such as a recorder 92 for recording data and a display or monitor 94 for displaying desired information. The use of control unit 90, display 94 and recorder 92 is known in the art of well logging and is, thus, not explained in greater detail herein.

Still referring to the illustrative embodiment of FIG. 1, FPS module 40 performs pumping operations for formation testing tool 20. In this example, FPS module 40 includes a precision pump designed to produce pressures in the range of 8000 psi above hydrostatic. Fluid testing module 31 forms part of FPS module 40 to analyze fluid during clean out of the fractures. Compartment 27 contains a pressurized tank 25 and proppant slurry housing 29, separated by a piston 33. Pressurization source tank 25 is a tank in fluid communication with proppant slurry housing 29 in order to provide the pressure necessary to inject proppant into formation 24, as will be discussed below. Pressurized tank 25 may be filled at the surface with, for example, nitrogen ($N_2$, e.g.), inert gas, expandable fluid or explosives. The specific type of proppant and fracturing fluid present in proppant slurry housing 29 may take any desired type.

Packer section 28 contains one or more packers/pads, such as 42*a* and 42*b* respectively, associated with probes 44*a* and 44*b*. These packer/pads are distinctly different from the earlier mentioned packers which serve to seal off vertical sections of the open hole wellbore. Instead, when pressed hard against the formation, these packer/pads create a tight seal between the probes 44*a* and 44*b* so as to direct and only allow the flow of fluids from the probes into the reservoir, and from the reservoir through the probes and into the tool. During operations, packer/pads 42*a* and 42*b* are urged against a desired formation, such as formation 24, by urging hydraulically activated rams 46*a* and 46*b*, positioned opposite to 42*a* and 42*b*, against wellbore wall 21*a*. An electro-hydraulic section (not shown) is housed in packer section 28, and includes a hydraulic pump for actuating probes 44*a* and 44*b*. Packer/pads 42*a* and 42*b* provide a seal to their respective probes 44*a* and 44*b* which embed into formation 24. Probes 44*a* and 44*b* are, among others, in fluid communication with compartment 27. As will be described in more detail below, in certain embodiments FPS module 40 is in fluid communication with compartment 27 in order to provide the pressure sufficient to fracture and proppant pack the fractures. In certain alternate embodiments, FPS module 40 is coupled to pressurized tank 25 in order to recharge pressurized tank 25 for subsequent fracturing.

The electro-hydraulic pump of packer section 28 can also deploy hydraulic rams 46*a* and 46*b*, which causes packers 42*a* and 42*b* to urge against the wellbore wall 21*a*. The system urges packers/pads 42*a* and 42*b* until a seal is formed between the packers/pads and wellbore wall 21*a* to ensure that there is a proper fluid communication between wellbore formation 24 and probes 44*a* and 44*b*. In alternative embodiments, any other suitable means may also be used for deploying packers/pads 42*a* and 42*b* for the purposes of this disclosure. Probes 44*a* and 44*b* radially extend away from the tool body and penetrate into formation 24 when packers/pads 42*a* and 42*b* are urged against the wellbore interior wall 21*a*. Packer/pad section 28 also contains pressure gauges (not shown) to monitor pressure changes during fluid sample collection process respectively from probes 44*a* and 44*b*.

FPS module 35, and various other valves, etc., control the formation fluid flow from the formation 24 into a flow line 50 via probes 44*a* and 44*b* during sampling. The pump operation is preferably controlled by control unit 90 or by a control circuit 38 located in tool 20. The fluid from probes 44*a* and 44*b* flows through flow line 50 and may be discharged into the wellbore via a port 52. A fluid control device, such as control valve, may be connected to the flow line for controlling the fluid flow from flow line 50 into the wellbore 21. In addition to these operations, control unit 90 also controls the fracturing and proppant placement whereby fracture fluid and proppant are forced from probes 44*a*, 44*b* and into formation 24, as will be discussed below.

Pressure gauge 66 is used to determine the static and flowing formation pressure. This gives the operator an idea of what production rates to expect and to help them better calculate surface facilities. Fluid testing module 32 contains a fluid testing device which analyzes the fluid flowing through flow line 50. For the purpose of this disclosure, any suitable device or devices may be utilized to analyze the fluid. A number of different devices have been used to determine certain downhole parameters relating to the formation fluid and the contents (oil, gas, water and solids) of the fluid. Such information includes, for example, the drawdown pressure of fluid being withdrawn, fluid density and temperature, and fluid composition. Sample collection module 34 contains at least one fluid collection chamber for collecting the formation fluid samples. Although not shown, sample collection module also includes a fluid control device to allow fluid communication between the sample collection module 34 and the wellbore 21 as desired. FPS module 35 is used to pump fluid past the fluid testing module 32 and into sample collection module 34 during sampling.

Figure 2A:
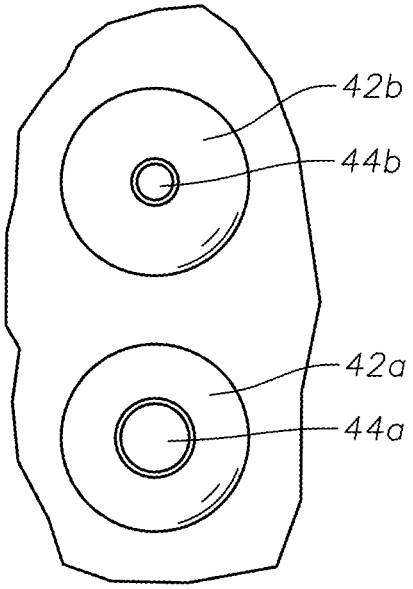
FIGS. 2A and 2B are facial views of the probes of a formation testing tool, according to certain alternative embodiments of the present disclosure.
Figure 2B:
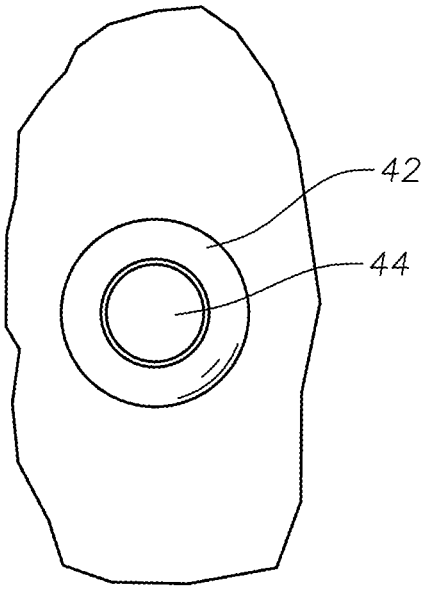

FIGS. 2A and 2B are facial views of the packer/probes of packer section 28, according to certain alternative embodiments of the present disclosure. In the embodiment of FIG. 1, two probes 44*a*, 44*b* are illustrated. In such embodiments, as shown in FIG. 2A, one of the probes (probe 44*a*, e.g.) is larger than the other probe so that the proppant slurry may flow through the larger probe. The other probe (probe 44*b*, e.g.) is smaller and used to receive the formation fluid. In an alternate embodiment as shown in FIG. 2B, a single large probe is utilized for all fluid communication (i.e., fracturing, proppant placement, and fluid sample acquisition).

Figure 3A:
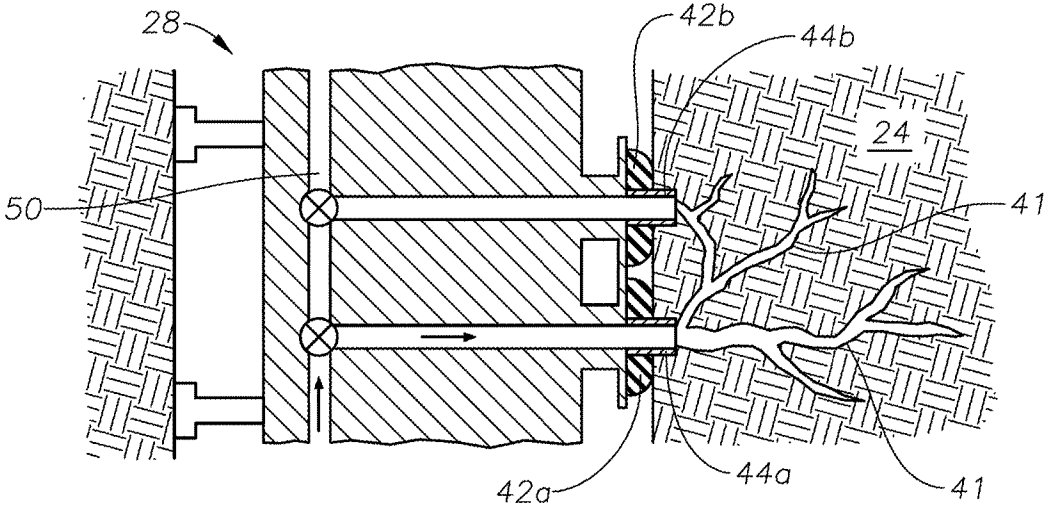
FIGS. 3A and 3B are exploded views of a formation testing tool during a fracturing operation, according to certain illustrative methods of the present disclosure.
Figure 3B:
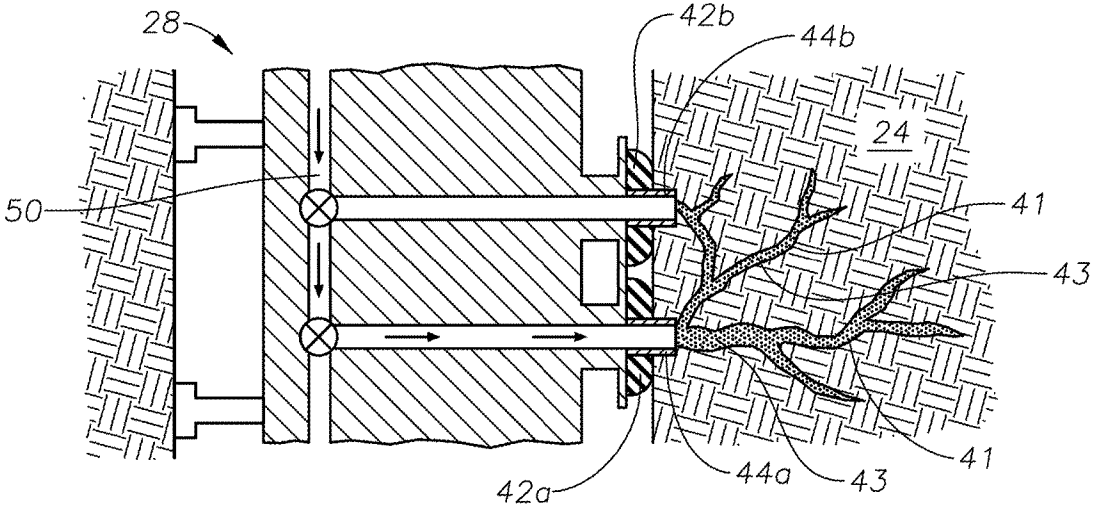

FIGS. 3A and 3B are exploded views of tool 20 during a fracturing operation, according to illustrative methods of the present disclosure. With reference to FIGS. 1-3B, to operate the formation testing system 10 of the present disclosure, tool 20 is conveyed into the wellbore 21 by means of the wireline 23 or another suitable means, such as a coiled tubing, to a desired location ("depth"). Packers/pads 42*a* and 42*b* are urged against the wellbore wall 21*a* at the zone of interest 24. The electro-hydraulic system of packer/pads section 28 deploys packers/pads 42*a* and 42*b* and backup hydraulic rams 46*a* and 46*b* to create a hydraulic seal between the elastomeric packers/pads 42*a* and 42*b* and the formation 24. Once packers/pads 42*a, b* are set, control unit 90 initiates FPS module 40 to apply pressure to proppant slurry housing 29 to thereby inject fracturing fluid via flow line 50 into formation 24 via probes 44*a* and/or 44*b*. In the illustrated example, probe 44*a* is used for fracturing because it is the larger of the probes (FIG. 2A). In other embodiments, both probes 44*a*, 44*b* may be used or only probe 44*b*. Note that, although not shown, tool 20 includes all valves necessary to effect alternative probe designs shown in FIGS. 2A and 2B, as such designs would be understood by those ordinarily skilled in the art having the benefit of this disclosure. Nevertheless, as shown in FIG. 3A, one or more fracture(s) 41 are formed as a result of the injection of the pressurized fracture fluid.

While fracture(s) 41 are still open, control unit 90 initiates compartment 27 to pressurize tank 25, which in turn forces piston 33 to apply corresponding pressure to proppant slurry housing 29. For example, if $N_2$ is used, the N2 will be pre-charged to the desired pressure at the surface. In other examples, if explosive material is used, an electrical or hydraulic signal could be used to activate the charge. A variety of methods may be utilized to determine the amount of material needed to fill pressurized tank 25. For example, using available data for the downhole temperature and hydrostatic pressure, the surface volume and charge pressure of the $N_2$ (or another material) can be quite accurately determined so that at reservoir conditions the $N_2$ charge will be sufficient to propel proppant 43 into fracture(s) 41. Take a specific example where the reservoir temperature is at 250 F and the reservoir pressure is at 6000 psi. Thus, FPS module 40 would be used to create a fracture at 8000 psi, for example. In this particular example, control unit 90 is used to determine the initial charge pressure of the $N_2$ at that particular ambient charge temperature so that the $N_2$ pressure at reservoir temperature will be sufficiently in excess of the bottom hole pressure psi so that when released, the $N_2$ pressure apply sufficient force to piston 33 to drive proppant 43 into the fracture(s) 41.

More specifically, using the additional pressure provided by pressurized tank 25, the proppant is communicated via flow line 50 through probe 44*a* in order to force the proppant 43 into fracture(s) 41 as shown in FIG. 3B. In certain embodiments, fracture(s) 41 may only be roughly 10 feet in length and referred to as "mini fractures." One of the advantages of this embodiment is that the use of compartment 27 avoids the negative effects of proppant delivery on the hydraulic pump in packer section 28. In general, proppant consists of hard beads that will serve to keep open the fracture even after the additional external pressure is removed. The proppant is traditionally carried as a viscous slurry in a liquid phase, usually water, which has its properties modified so that it can act as a carrier for the solid, weighted, proppant phase, ensuring that the proppant remains in suspension during transport and delivery. While the pump of packer/probe section 28 can in theory be used to deliver the viscous proppant phase, in practice the slurry phase containing the proppant will severely affect the performance of the internal components associated with the pump and quickly curtail its effective downhole life. Therefore, through the use of compartment 27 in the embodiments provided herein, such effects can be avoided.

After the fracture is complete, in certain illustrative methods, formation testing tool 20 is reversed using FPS module 40 in order to clean out fracture(s) 41. As a result, excess proppant 43 will be pulled back into probes 44*a* and/or 44*b*. After proppant placement is complete, formation pressures are taken and/or fluid is sampled (using FPS module 35) from formation 24 via probes 44*a* and/or 44*b*, analyzed by fluid testing module 32 and stored in a sample collection module 34, as understood in the art.

In an alternate embodiment, both the fracture initiation and the proppant placement may be performed by the material in pressurized tank 25. In this embodiment, FPS module 40 will not be used to perform fracturing. Instead, the volume and pressure of the pressurized tank 25 will be adjusted so that when the material in pressurized tank 25 is released, the pressurized fluid will generate both the requisite fracture and the proppant placement pressure.

In certain illustrative methods of the present disclosure, multiple zones along formation 24 may be fractured using formation testing tool 20. Depending on the size of the compartment 27 and the specific application, the material of pressurized tank 25 will need to be sufficient to support multiple fractures along multiple zones. In such an embodiment, FPS module 40 may be utilized to recharge the pressure in pressurized tank 25 depleted during previous fracture operations. Here, fracturing/proppant placement is conducted at a first zone, then formation testing tool 20 is moved to a second zone where the operation is conducted again. This could be expedited by either using FPS module 40 to charge additional fluid to the viscous slurry, thus re-pressurizing the $N_2$ or other pressurization material, or adding fluid directly to the $N_2$ side to increase the pressure. Additionally, in yet other embodiments, multiple pressurized tank 25 could be charged and used at different fracturing points. In other embodiments, formation testing tool 20 may include multiple compartments containing proppant slurry and/or fracture fluid in order to fracture multiple zones along a wellbore.

In yet another illustrative method of the present disclosure, control unit 90, via precision reversal of hydraulic pump 39, controls the rate of depressurization to prevent the proppant from being pushed out of the fractures. After initiating the fracture, FPS module 40 begins to pump out at a slow controlled rate. Therefore, the depressurization is controlled. If the fracture were allowed to depressurize rapidly, as is conventionally done, the fluid containing the proppant would be ejected from the fracture at a high rate and carry an undesirably large volume of the proppant out with it, leaving behind insufficient volume of proppant to deliver a high permeability fracture. By limiting the rate at which the fracture is allowed to close, a more compact proppant pad is generated resulting in a more permeable fracture. As previously described, the pump utilized in FPS module 40 is highly precise, such as, for example, a "dog bone" pump which strokes back and forth with a series of check vales controlling fluid flow direction. A potentiometer is used to indicate the pump's position and how fast its moving as it strokes back and forth. Using an electronically controlled valve, the hydraulic flow speed of the pump may be controlled.

Figure 4:
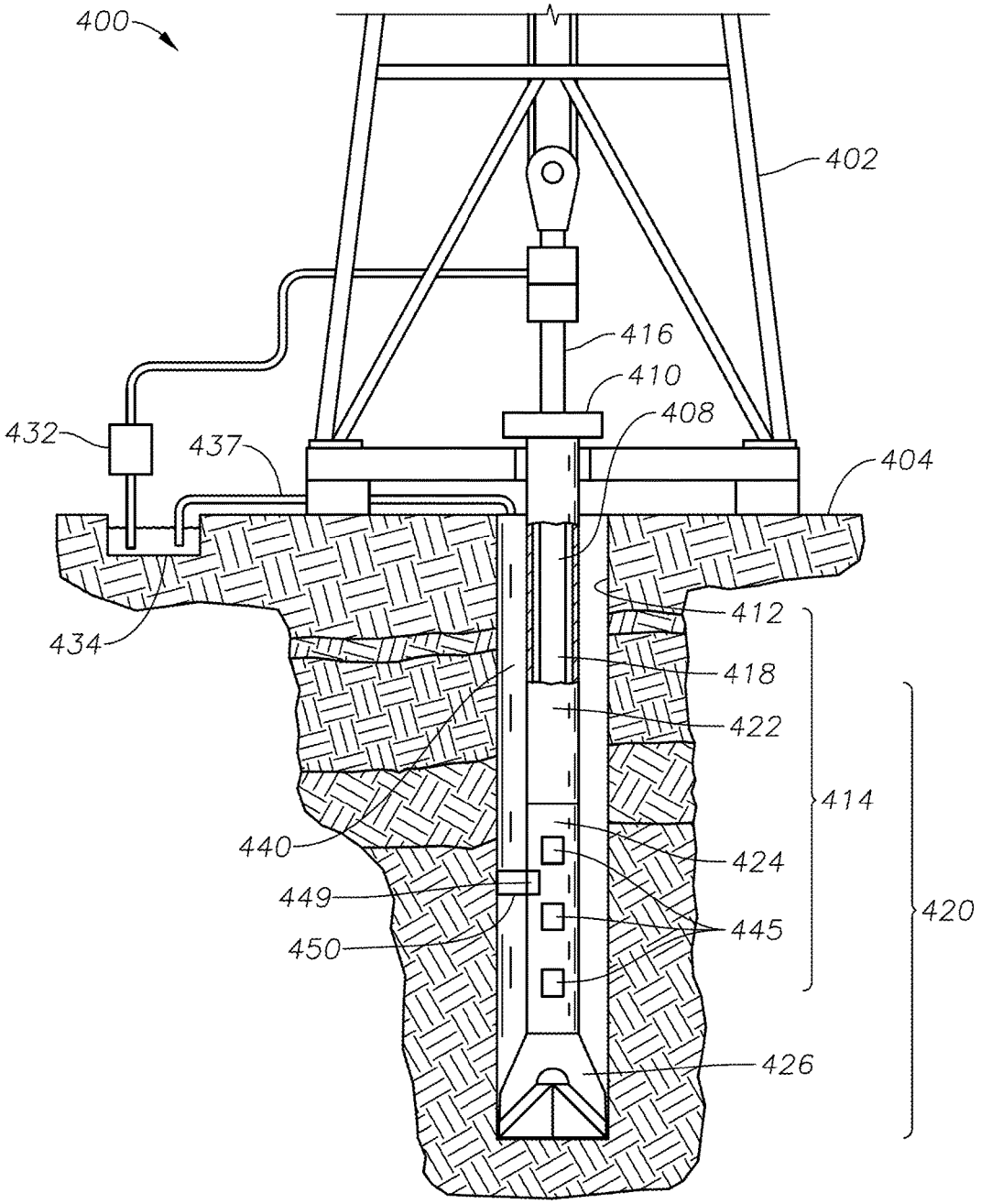
FIG. 4 illustrates a formation testing system for drilling operations according to certain illustrative embodiments of the present disclosure.

FIG. 4 illustrates a formation testing system 400 for drilling operations according to an illustrative embodiment of the present disclosure. It should be noted that formation testing system 400 can also include a system for pumping or other operations. Formation testing system 400 includes a drilling rig 402 located at a surface 404 of a wellbore. Drilling rig 402 provides support for a down hole apparatus, including a drill string 408. Drill string 408 penetrates a rotary table 410 for drilling a borehole/wellbore 412 through subsurface formations 414. Drill string 408 includes a Kelly 416 (in the upper portion), a drill pipe 418 and a bottom hole assembly 420 (located at the lower portion of drill pipe 418). In certain illustrative embodiments, bottom hole assembly 420 may include drill collars 122, a downhole tool 424 and a drill bit 426. Downhole tool 424 may be any of a number of different types of tools including measurement-while-drilling ("MWD") tools, logging-while-drilling ("LWD") tools, etc.

During drilling operations, drill string 408 (including Kelly 416, drill pipe 418 and bottom hole assembly 420) may be rotated by rotary table 410. In addition or alternative to such rotation, bottom hole assembly 420 may also be rotated by a motor that is downhole. Drill collars 422 may be used to add weight to drill bit 426. Drill collars 422 also optionally stiffen bottom hole assembly 420 allowing it to transfer the weight to drill bit 426. The weight provided by drill collars 422 also assists drill bit 426 in the penetration of surface 404 and subsurface formations 414.

During drilling operations, a mud pump 432 optionally pumps drilling fluid (e.g., drilling mud), from a mud pit 434 through a hose 436, into drill pipe 418, and down to drill bit 426. The drilling fluid can flow out from drill bit 426 and return back to the surface through an annular area 440 between drill pipe 418 and the sides of borehole 412. The drilling fluid may then be returned to the mud pit 434, for example via pipe 437, and the fluid is filtered. The drilling fluid cools drill bit 426, as well as provides for lubrication of drill bit 426 during the drilling operation. Additionally, the drilling fluid removes the cuttings of subsurface formations 414 created by drill bit 426.

Still referring to FIG. 4, downhole tool 424 may include one to a number of different sensors 445, which monitor different downhole parameters and generate data that is stored within one or more different storage mediums within the downhole tool 424. Alternatively, however, the data may be transmitted to a remote location (e.g., surface) and processed accordingly. The type of downhole tool 424 and the type of sensors 445 thereon may be dependent on the type of downhole parameters being measured. Such parameters may include the downhole temperature and pressure, the various characteristics of the subsurface formations (such as resistivity, radiation, density, porosity, etc.), the characteristics of the borehole (e.g., size, shape, etc.), etc.

Downhole tool 424 further includes a power source 449, such as a battery or generator. A generator could be powered either hydraulically or by the rotary power of the drill string. In this illustrative embodiment, downhole tool 424 includes a formation testing tool 450 as previously described herein, which can be powered by power source 449. In an embodiment, formation testing tool 450 is mounted on drill collar 422. Formation testing tool 450 engages the wall of borehole 412, fractures and proppant packs formations 414, and extracts a sample of the fluid in formation 414 via a flow line, as previously described. In addition to drilling applications, embodiments of the present disclosure may also be deployed in a variety of other ways, including for example, slickline applications.

Embodiments described herein further relate to any one or more of the following paragraphs:

1. A method for fracturing a wellbore, the method comprising: deploying a downhole tool into a wellbore, the downhole tool containing proppant slurry, the proppant slurry comprising proppant and fracture fluid; forming one or more fractures along the wellbore using the downhole tool; and injecting the proppant slurry into the fractures using the downhole tool.

2. A method as defined in paragraph 1, wherein forming the one or more fractures comprises applying pressure to the wellbore using a pump forming part of the downhole tool; and injecting the proppant slurry comprises supplying the proppant slurry from a high pressure tank forming part of the downhole tool.

3. A method as defined in paragraphs 1 or 2, wherein forming the one or more fractures comprises applying pressure to the wellbore using a high pressure tank forming part of the downhole tool; and injecting the proppant slurry comprises injecting the proppant slurry using the high pressure tank.

4. A method as defined in any of paragraphs 1-3, further comprising, after injecting the proppant slurry, recharging the high pressure tank using a pump forming part of the downhole tool.

5. A method as defined in any of paragraphs 1-4, wherein forming the one or more fractures comprises isolating a zone of the wellbore using a probe of the downhole tool; and applying pressure to the wellbore along the zone via the probe, the pressure being sufficient to form the one or more fractures, wherein, after the injection of the proppant slurry, the method further comprises controlling a rate of depressurization of the one or more fractures using the downhole tool.

6. A method as defined in any of paragraphs 1-5, wherein the downhole tool is deployed along a wireline as a wireline formation tester.

7. A method as defined in any of paragraphs 1-6, wherein the downhole tool is deployed along a drilling assembly.

8. A method as defined in any of paragraphs 1-7, wherein forming the one or more fractures comprises generating pressure to be applied to the wellbore using nitrogen, inert gas, expandable fluid or explosives positioned inside the downhole tool; and applying the pressure to the wellbore until the one or more fractures are initiated.

9. A method as defined in any of paragraphs 1-8, wherein forming the one or more fractures comprises forming the one or more fractures at a first zone; injecting the proppant slurry comprises injecting the proppant slurry into the one or more fractures at the first zone; and the method further comprises moving the downhole tool to a second zone; fracturing the second zone using the downhole tool; and injecting the proppant slurry into the fractured second zone using the downhole tool.

10. A method as defined in any of paragraphs 1-10, wherein forming the one or more fractures comprises forming a fracture of roughly 10 feet in length.

11. A downhole tool for fracturing a wellbore, the downhole tool comprising a compartment containing a proppant slurry, the proppant slurry comprising proppant and fracture fluid; and a probe to isolate a zone of a wall of the wellbore, the probe being in fluid communication with the compartments, wherein the downhole tool is configured to produce one or more fractures along the isolated portion of the wellbore wall using the fracture fluid, and further configured to inject the proppant into the one or more fractures.

12. A downhole tool as defined in paragraph 11, further comprising a piston positioned within the compartment.

13. A downhole tool as defined in paragraphs 11 or 12, wherein a pump is in communication with the compartment.

14. A downhole tool as defined in any of paragraphs 11-13, wherein the piston separates the compartment into a pressurized tank and a proppant slurry housing.

15. A downhole tool as defined in any of paragraphs 11-14, wherein the pressurized tank comprises at least one of nitrogen, inert gas, expandable fluid or explosives.

16. A downhole tool as defined in any of paragraphs 11-15, wherein the probe comprises a first probe for the proppant; and a second probe for the fracture fluid, wherein the first probe is larger than the second probe.

17. A downhole tool as defined in any of paragraphs 11-16, further comprising a second compartment containing proppant slurry having proppant and fracture fluid therein, the probe being in fluid communication with the second compartment, wherein the downhole tool is configured to produce one or more fractures along a second isolated portion of the wellbore wall using the fracture fluid of the second compartment, and further configured to inject the proppant of the second compartment into the one or more fractures of the second isolated portion.

18. A downhole tool as defined in any of paragraphs 11-17, wherein the downhole tool is a wireline formation tester.

19. A downhole tool as defined in any of paragraphs 11-18, wherein the downhole tool forms part of a drilling assembly.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may have been used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A method for fracturing a wellbore, the method comprising:

deploying a downhole tool into a wellbore, the downhole tool comprising:

a downhole tool housing;

a compartment positioned within the housing, the compartment comprising:

a proppant slurry housing containing a proppant slurry, the proppant slurry comprising proppant and fracture fluid;

a pressurized tank in fluid communication with the proppant slurry housing; and a piston separating the proppant slurry housing and pressurized tank;

a pump positioned within the housing, the pump being in fluid communication with the proppant slurry housing and pressurized tank; and a probe to isolate a zone of a wall of the wellbore, the probe being in fluid communication with the compartment;

forming one or more fractures along the wellbore using the pressurized tank or pump; and injecting the proppant slurry into the fractures using the pressurized tank.

2. A method as defined in claim 1, further comprising, after injecting the proppant slurry, recharging the high pressure tank using the pump.

3. A method as defined in claim 1, wherein forming the one or more fractures comprises:

isolating a zone of the wellbore using a probe of the downhole tool; and applying pressure to the wellbore along the zone via the probe, the pressure being sufficient to form the one or more fractures, wherein, after the injection of the proppant slurry, the method further comprises controlling a rate of depressurization of the one or more fractures using the downhole tool.

4. A method as defined in claim 1, wherein the downhole tool is deployed along a wireline as a wireline formation tester.

5. A method as defined in claim 1, wherein the downhole tool is deployed along a drilling assembly.

6. A method as defined in claim 1, wherein forming the one or more fractures comprises:

generating pressure to be applied to the wellbore using explosives positioned inside the downhole tool; and applying the pressure to the wellbore until the one or more fractures are initiated.

7. A method as defined in claim 1, wherein:

forming the one or more fractures comprises forming the one or more fractures at a first zone;

injecting the proppant slurry comprises injecting the proppant slurry into the one or more fractures at the first zone; and the method further comprises:

moving the downhole tool to a second zone;

fracturing the second zone using the downhole tool; and injecting the proppant slurry into the fractured second zone using the downhole tool.

8. A method as defined in claim 1, wherein forming the one or more fractures comprises forming a fracture of roughly 10 feet in length.

9. A downhole tool for fracturing a wellbore, the downhole tool comprising:

a downhole tool housing;

a compartment positioned within the housing, the compartment comprising:

a proppant slurry housing containing a proppant slurry, the proppant slurry comprising proppant and fracture fluid;

a pressurized tank in fluid communication with the proppant slurry housing; and a piston separating the proppant slurry housing and pressurized tank;

a pump positioned within the housing, the pump being in fluid communication with the proppant slurry housing and pressurized tank; and a probe to isolate a zone of a wall of the wellbore, the probe being in fluid communication with the compartment, wherein the downhole tool is configured to produce one or more fractures along the isolated portion of the wellbore wall using the fracture fluid, and further configured to inject the proppant into the one or more fractures.

10. A downhole tool as defined in claim 9, wherein the pressurized tank comprises an explosive.

11. A downhole tool as defined in claim 9, wherein the probe comprises:

a first probe for the proppant; and a second probe for the fracture fluid, wherein the first probe is larger than the second probe.

12. A downhole tool as defined in claim 9, further comprising a second proppant slurry housing containing proppant slurry having proppant and fracture fluid therein, the probe being in fluid communication with the second proppant slurry housing, wherein the downhole tool is configured to produce one or more fractures along a second isolated portion of the wellbore wall using the fracture fluid of the second proppant slurry housing, and further configured to inject the proppant of the second proppant slurry housing into the one or more fractures of the second isolated portion.

13. A downhole tool as defined in claim 9, wherein the downhole tool is a wireline formation tester.

14. A downhole tool as defined in claim 9, wherein the downhole tool forms part of a drilling assembly.

* * * * *